US005749501A

United States Patent [19]

Maas et al.

[11] Patent Number: 5,749,501

[45] Date of Patent: May 12, 1998

[54] SHROUD AND SKELETAL BODY FOR TRIGGER SPRAYER

[75] Inventors: Wilhelmus J. J. Maas; Petrus L. W. Hurkmans, both of Someren, Netherlands

[73] Assignee: AFA Products, Inc., Forest City, N.C.

[21] Appl. No.: 660,868

[22] Filed: Jun. 10, 1996

[51] Int. Cl.[6] ..... B65D 37/00

[52] U.S. Cl. ..... 222/384; 222/383.1; 222/207; 239/333

[58] Field of Search ..... 222/182, 207, 222/383.1, 384; 239/333

[56] References Cited

U.S. PATENT DOCUMENTS

| | | | |
|---|---|---|---|
| D. 332,652 | 1/1993 | Foster et al. | D23/226 |
| D. 354,226 | 1/1995 | Foster et al. | D9/448 |
| 3,820,721 | 6/1974 | Hellenkamp | 239/288.5 |
| 4,138,038 | 2/1979 | Grogan | 222/207 |
| 4,155,487 | 5/1979 | Blake | 222/207 |
| 4,161,288 | 7/1979 | McKinney | 239/333 |
| 4,216,882 | 8/1980 | Basile et al. | 222/207 |
| 4,222,501 | 9/1980 | Hammett et al. | 222/207 |
| 4,225,061 | 9/1980 | Blake et al. | 222/207 |
| 4,241,853 | 12/1980 | Pauls et al. | 222/207 |
| 4,257,539 | 3/1981 | Cary et al. | 222/182 |
| 4,911,361 | 3/1990 | Tada . | |
| 4,940,186 | 7/1990 | Tada . | |
| 4,953,791 | 9/1990 | Tada | 239/333 |
| 4,955,511 | 9/1990 | Blake | 222/321 |
| 4,982,900 | 1/1991 | Blake | 239/333 |
| 5,156,304 | 10/1992 | Battegazzore | 222/341 |
| 5,332,129 | 7/1994 | Brattoli et al. | 239/333 |
| 5,356,049 | 10/1994 | Harris et al. | 222/383 |
| 5,366,121 | 11/1994 | Foster et al. | 222/383 |

FOREIGN PATENT DOCUMENTS 0718044 6/1996 European Pat. Off. .

*Primary Examiner*—J. Casimer Jacyna
*Attorney, Agent, or Firm*—Thomas R. Vigil

[57] ABSTRACT

The shroud and skeletal body assembly for a trigger sprayer comprises: a skeletal body including a lower portion, an upright body portion extending upwardly from the lower portion and having a forwardly extending piston receiving portion, a waterway defining portion above the piston receiving portion and extending forwardly of the upright body portion, and hook structure extending rearwardly from the upright body portion; and a shroud having a top wall, spaced apart side walls, a back wall, and a short rear bottom wall extending forwardly from the back wall, and latch structure extending between the side walls at a position to be engaged by the hook structure when the shroud is brought into engagement with the skeletal body.

6 Claims, 6 Drawing Sheets

FIG. 6
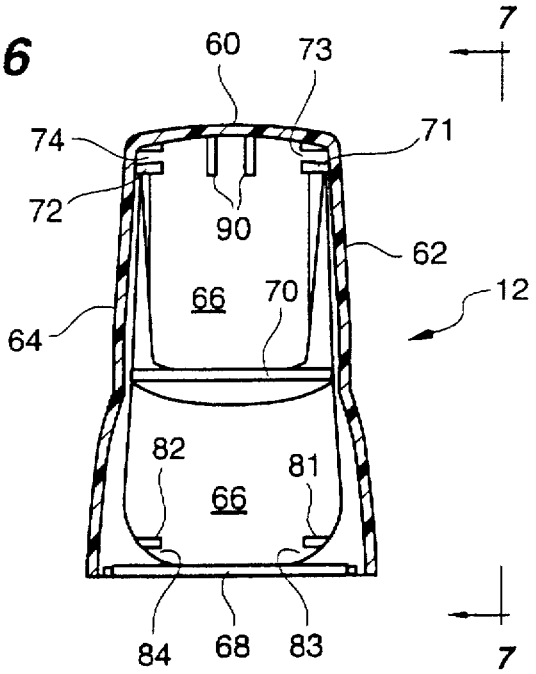
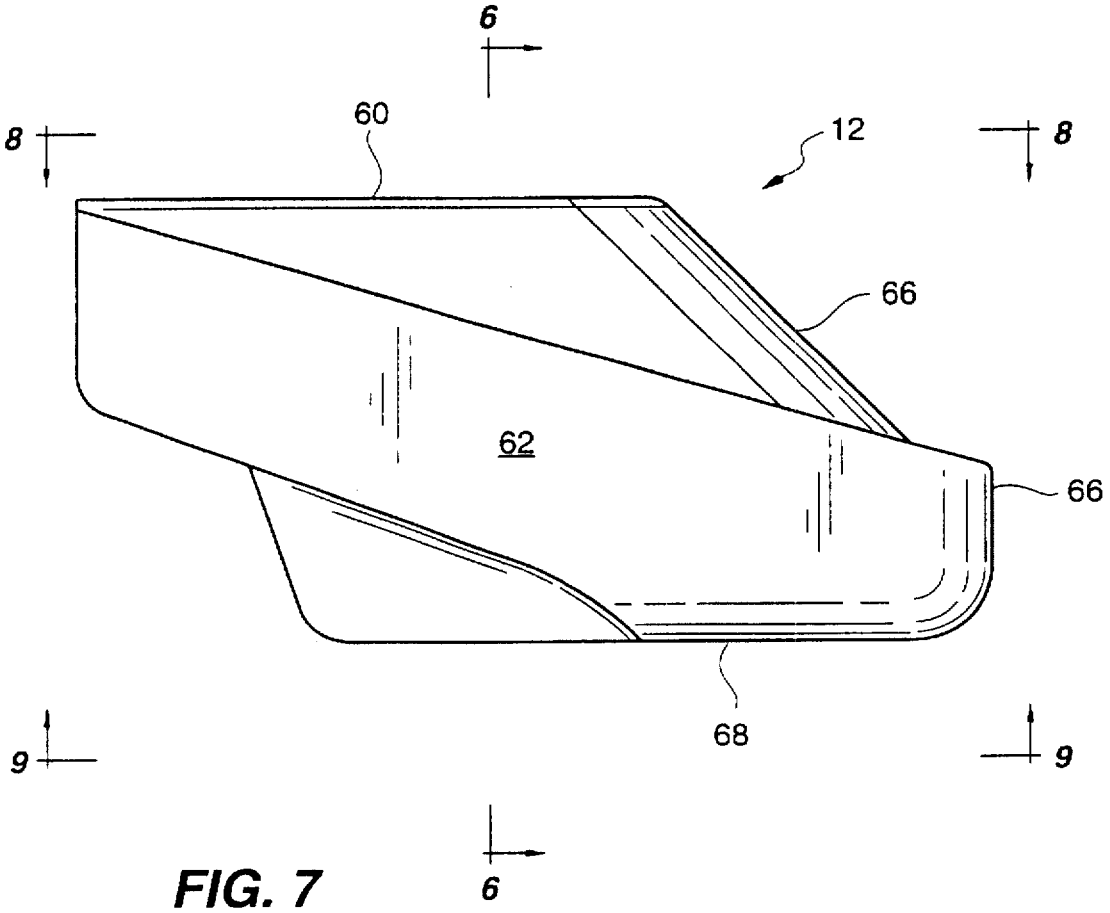
FIG. 7

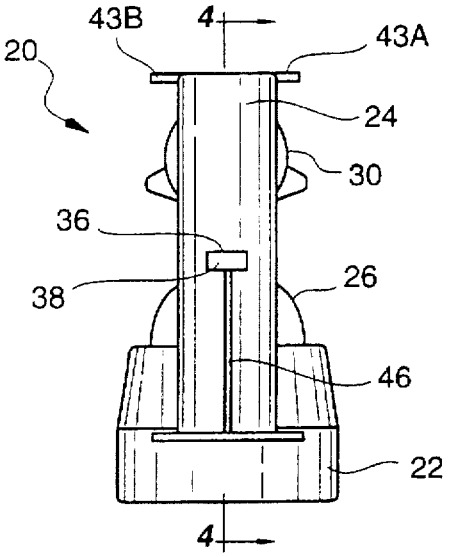
FIG. 10
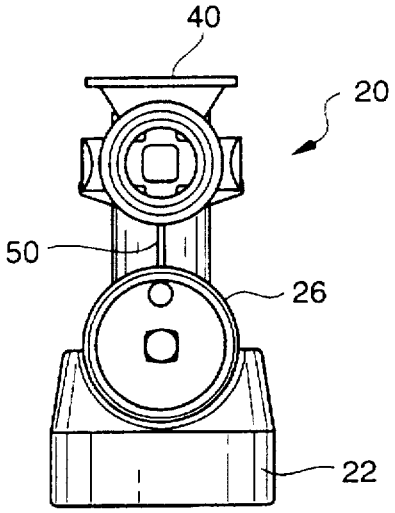
FIG. 11
FIG. 12
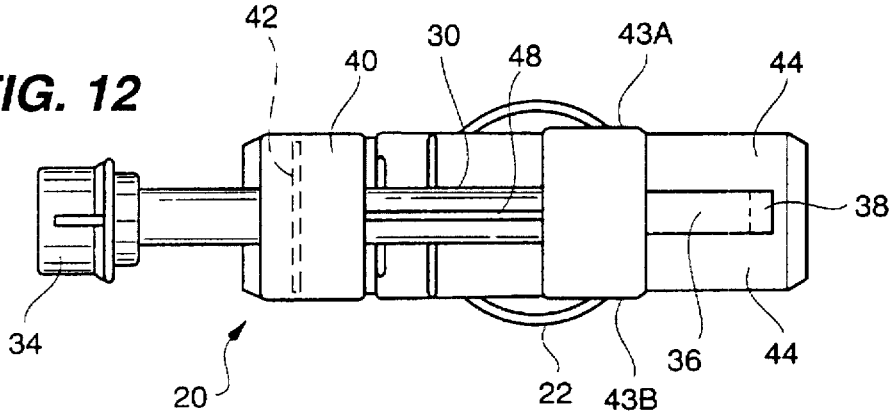
FIG. 13
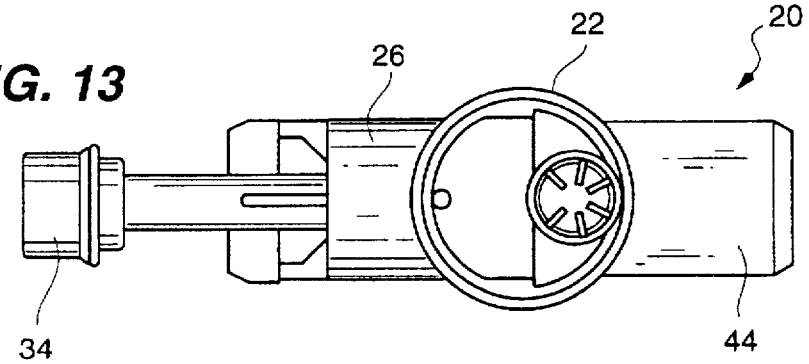

SHROUD AND SKELETAL BODY FOR TRIGGER SPRAYER

FIELD OF THE INVENTION

1. The present invention relates to a shroud constructed to be snap-fittingly mounted onto a skeletal body of a trigger sprayer, the shroud including skeletal body engaging structure for engaging mating structure on the skeletal body.

2. Description of the related art including information disclosed under 37 CFR §§1.97–1.99.

Heretofore various assemblies of detachable shrouds, housings, covers or shells for mounting to a body of a trigger sprayer have been proposed.

Examples of such previously proposed shrouds, housings, covers or shells having body engaging structure for engaging a body of a trigger sprayer are disclosed in the following U.S. patents:

| U.S. Pat. No. | Patentee |
|---|---|
| 3,820,721 | Hellenkamp |
| 4,138,038 | Grogan |
| 4,161,288 | McKinney |
| 4,257,539 | Cary et al. |
| 4,953,791 | Tada et al. |
| 4,955,511 | Blake |
| 4,982,900 | Blake |
| 5,356,049 | Harris, et al. |
| 5,366,121 | Foster et al. |
| 354,226 | Foster et al. |
| 332,652 | Foster et al. |

The Foster et al. U.S. Pat. No. 5,366,121 discloses a snap-action coupler between a housing and a fluid dispensing apparatus. The housing includes structure for attaching the housing to the fluid dispensing apparatus including at least one projecting member having a free end adapted to engage the fluid dispensing apparatus.

SUMMARY OF THE INVENTION

According to the present invention there is provided a shroud and skeletal body assembly for a trigger sprayer comprising: a skeletal body including a lower portion, an upright body portion extending upwardly from the lower portion and having a forwardly extending piston receiving portion, a waterway defining portion above the piston receiving portion and extending forwardly of the upright body portion, and hook structure extending rearwardly from the upright body portion; and a shroud having a top wall, spaced apart side walls, a back wall, and a short rear bottom wall extending forwardly from the back wall, and latch structure extending between the side walls at a position to be engaged by the hook structure when the shroud is brought into engagement with the skeletal body.

BRIEF DESCRIPTION OF THE DRAWINGS

FIG. 6 is a front elevational view of the shroud shown in FIG. 5 and is taken along line 6—6 of FIG. 5.

FIG. 7 is a side elevational view of the shroud as shown in FIG. 1 but with other portions of the trigger sprayer omitted.

FIG. 10 is a back elevational view of the skeletal body shown in FIG. 4 and is taken along line 10—10 of FIG. 4.

FIG. 11 is a front elevational view of the skeletal body shown in FIG. 4 and is taken along line 11—11 of FIG. 4.

FIG. 12 is a top plan view of the skeletal body shown in FIG. 4 and is taken along line 12—12 of FIG. 4.

FIG. 13 is a bottom plan view of the skeletal body shown in FIG. 4 and is taken along line 13—13 of FIG. 4.

DESCRIPTION OF THE PREFERRED EMBODIMENT

Figure 1:
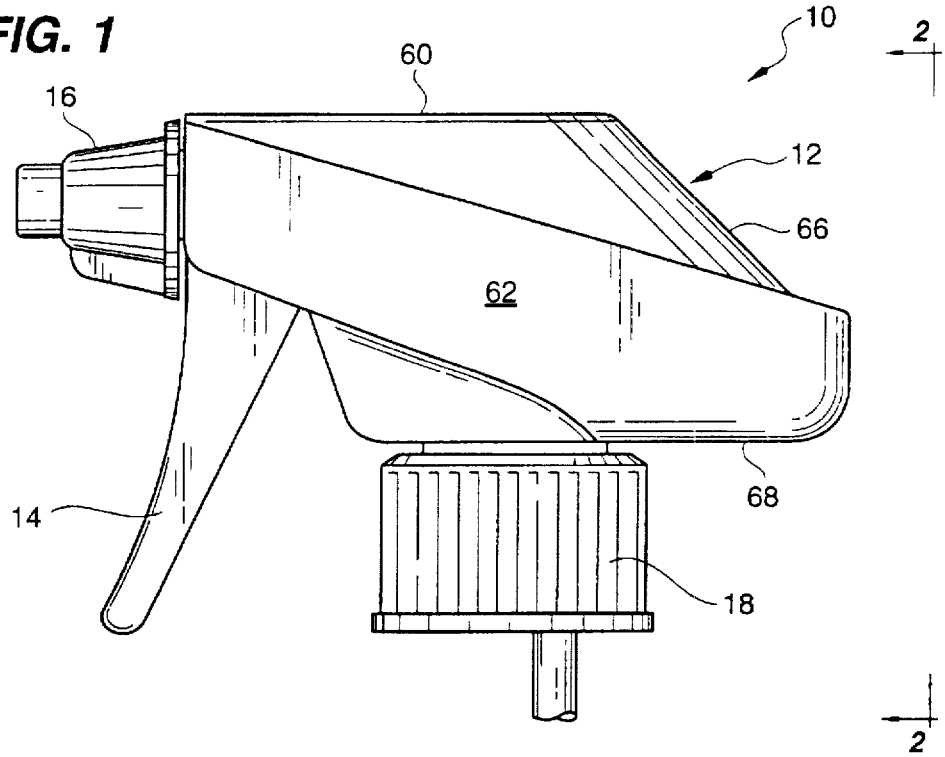
FIG. 1 is a side elevational view of a trigger sprayer including a shroud constructed according to the teachings of the present invention.
Figure 2:
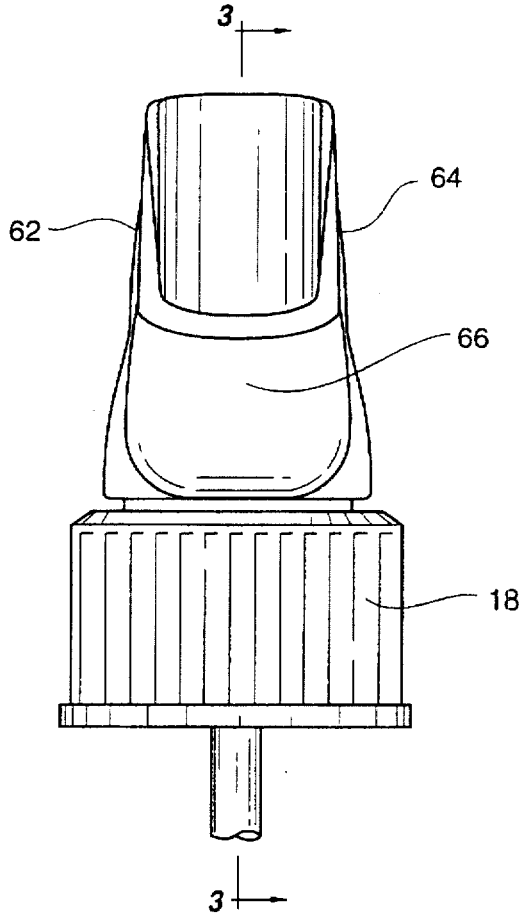
FIG. 2 is a back elevational view of the trigger sprayer shown in FIG. 1 and is taken along line 2—2 of FIG. 1.
Figure 3:
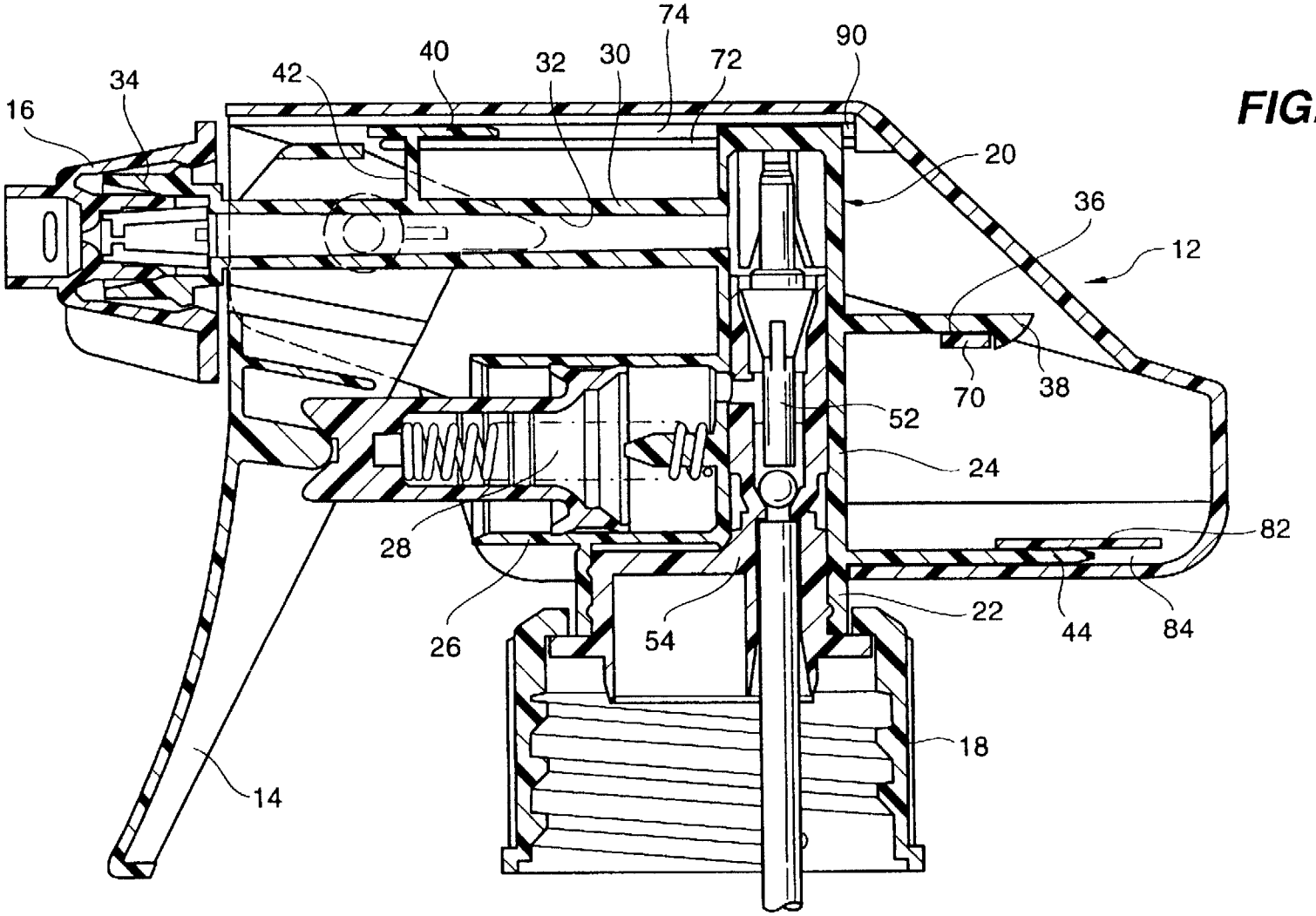
FIG. 3 is a vertical sectional view of the trigger sprayer shown in FIG. 2 and is taken along line 3—3 of FIG. 2.
Figure 4:
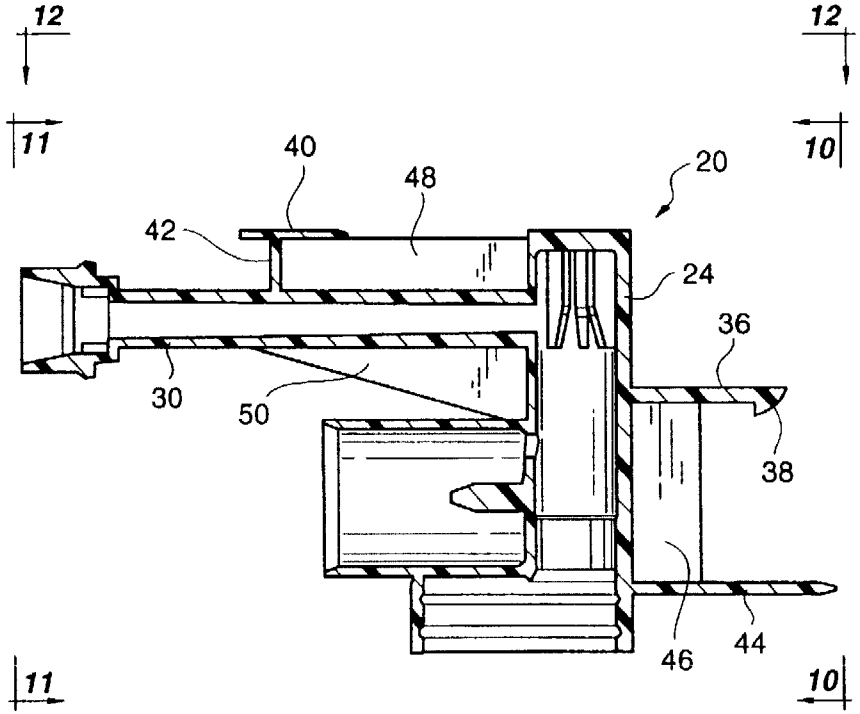
FIG. 4 is a vertical sectional view of the skeletal body of the trigger sprayer as shown in FIG. 3 but with other parts of the sprayer omitted.
Figure 8:
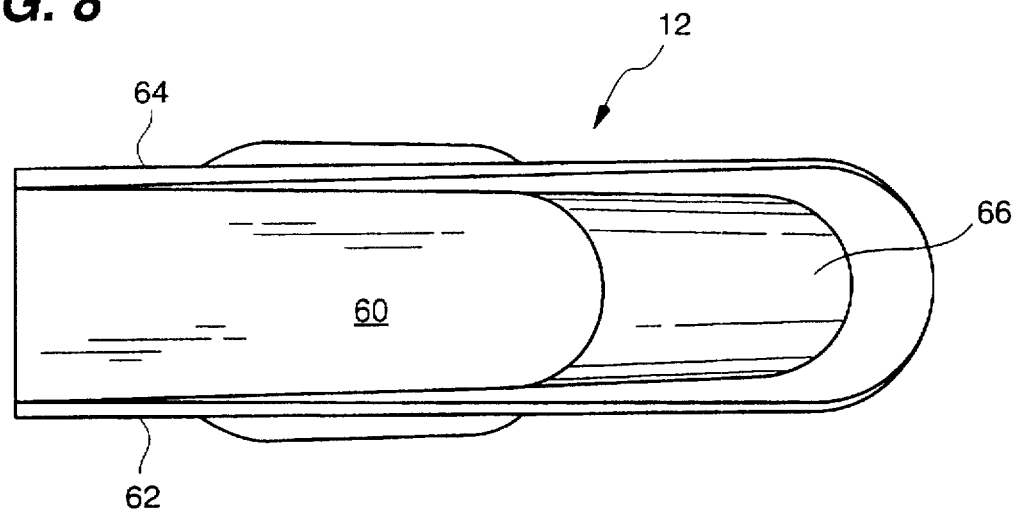
FIG. 8 is a top plan view of the shroud shown in FIG.7 and is taken along line 8—8 of FIG. 7.
Figure 9:
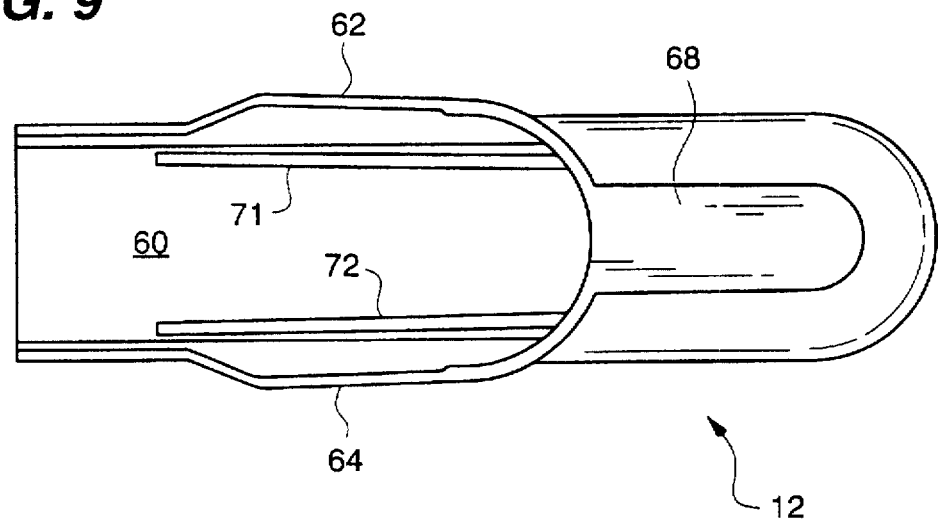
FIG. 9 is a bottom plan view of the shroud shown in FIG. 7 and is taken along the line 9—9 of FIG. 7.

Referring now to the drawings in greater detail, there is illustrated in FIG. 1 a trigger sprayer 10 comprising a shroud (shell, housing or cover) 12, a trigger 14, a nozzle 16, a bottle cap 18, and a skeletal body 20 (FIGS. 3 and 4).

Figure 5:
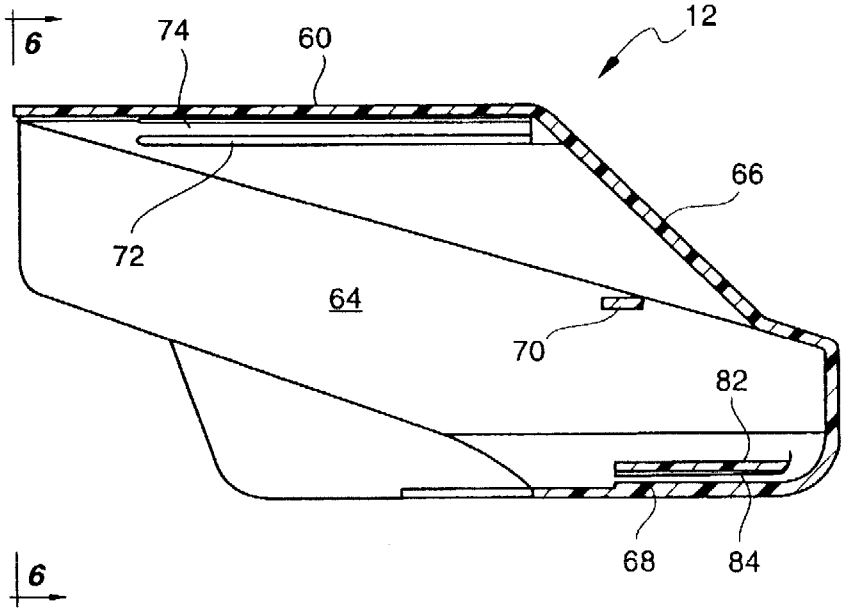
FIG. 5 is a vertical sectional view of the shroud as shown in FIG. 3 but with other parts of the sprayer omitted.

As best shown in FIGS. 3, 4 and 5, the shroud 12 and skeletal body 20 of the present invention include the shroud 12, constructed in the manner shown in FIGS. 3 and 5 including skeletal body engaging structure to be described hereinafter in greater detail for engaging the skeletal body 20 constructed in the manner shown in FIGS. 3 and 4 and including shroud engaging structure to be described hereinafter in greater detail for engaging the shroud 12.

As best shown in FIG. 3, the skeletal body 20 includes a lower cylindrical portion 22, an upright body portion 24, a piston receiving cylindrical portion 26 extending forward from the upright body portion 24 and receiving a piston 28 therein, and a waterway defining portion 30 having a waterway 32 therein and being located above the piston receiving cylindrical portion 26 and extending forwardly of the upright body portion 24.

The waterway defining portion 30 has a nose bushing 34 at a forward distal end thereof for receiving the nozzle 16.

Referring now to FIG. 4 in greater detail, the skeletal body 20 includes shroud engaging structure defined as follows:

(a) a hook member 36 extending rearwardly from the upright body portion 24 and having a hook formation 38 at an outer distal end thereof;

(b) a generally square flat plate 40 mounted at an upper end of a cross bar 42 extending a short distance from and above the waterway defining portion 30 and side flanges 43A and 43B at the upper end of the upright body portion 24; and, (c) a planer shelf 44 extending rearwardly from the skeletal body 20 below the hook member 36 and interconnected therewith by a web 46.

A webbing 48 extends between the cross bar 42 and the upright body portion 24 and above the waterway defining portion 30, as shown. Another webbing 50 extends from and below the waterway defining portion 30 angularly to the upright body portion 24.

As shown in FIG. 3, a valve structure 52 (which can be of the type disclosed in U.S. Pat. No. 4,669,664) co-acts with an intake body 54 received in the lower cylinder portion 22.

Referring now to FIGS. 5–9, the shroud 12 is a specially configured shell or housing having a top wall 60, opposite sidewalls 62 and 64, an irregularly shaped, partially inclined, backwall 66, and a bottom wall 68 extending forwardly a short distance from the backwall 66.

As shown in FIG. 5, the shroud 12 has on the inside thereof skeletal body engaging structure including:

(d) a latch bar 70 extending between the walls 62 and 64 and located as so as to be engaged by the hook formation 38 of the hook member 36;

(e) an upper rib 71, 72 extending inwardly from the inner surface of each sidewall 62, 64 a short distance and extending forwardly of the shroud 12 parallel to and a short distance below the inner surface of the top wall 60 so to form a slot 73, 74 therebetween for receiving, in a secure manner, the plate 40 in FIG. 3 and flanges 43A and 43B as shown in FIG. 10; and, (f) a lower rib 81, 82 each extending a short distance inwardly from the inner surface of the sidewalls 62, 64 and a short distance above the bottom wall 68 for forming slots 83 and 84 for receiving the shelf 44.

From the foregoing description it will be apparent that the shroud 12 is slid forwardly onto the skeletal body 20 from the rear thereof with the flanges 43A and 43B and the plate 40 engaging in the slots 73, 74 and the shelf 44 being received in the slots 83 and 84 until the latch bar 70 snap-fittingly engages the hook formation 38 and a stop formation 90 engages the upright body portion 24.

Also from the foregoing description it will be understood that the shroud 12 and skeletal body engaging structure (d), (e) and (f) for engaging the shroud engaging structure (a), (b) and (c) on the skeletal body 20 provides a simple and efficient mechanism for mounting the shroud 12 in a snap-action latching manner to the skeletal body 20.

Further, it will be apparent that modifications can be made to the shroud 12 and skeletal body 20 without departing from the teachings of the present invention. Accordingly, the scope of the invention is only to be limited as necessitated by the accompanying claims.

I claim:

1. A shroud and skeletal body assembly for a trigger sprayer comprising: a skeletal body including a lower portion, an upright body portion extending upwardly from said lower portion and having a forwardly extending piston receiving portion, a waterway defining portion above said piston receiving portion and extending forwardly of the upright body portion, and hook means extending rearwardly from said upright body portion; and a shroud having a top wall, spaced apart side walls, a back wall, and a short rear bottom wall extending forwardly from said back wall, and latch means located between said side walls at a position to be engaged by said hook means when said shroud is brought into engagement with said skeletal body; and, said skeletal body including shroud engaging means in the form of lateral projecting means or slot means above said waterway defining portion; said shroud having skeletal body engaging means in the form of mating slot means or mating lateral projectig means adapted to engage said shroud engaging means when said shroud is brought into engagement with said skeletal body, and said shroud engaging means of said skeletal body or said skeletal body engaging means of said shroud comprising at least one lateral projection and said skeletal means of said skeletal body including at least one rib or rail extending inwardly from an inner surface of at least one of said side walls of said shroud and longitudinally of said shroud or outwardly from said skeletal body, for defining, with a longitudinally extending surface of said shroud or of said skeletal body, a slot for receiving said at least one lateral projection.

2. The shroud and skeletal body assembly of claim 1 wherein said hook means includes a bar extending rearwardly from said upright body portion and having a hook formation at an outer end thereof and said latch means comprising a bar that extends between said side walls.

3. A shroud and skeletal body assembly for a trigger sprayer comprising: a skeletal body including a lower portion, an upright body portion extending upwardly from said lower portion and having a forwardly extending piston receiving portion, a waterway defining portion above said piston receiving portion and extending forwardly of the upright body portion, and hook means extending rearwardly from said upright body portion; a shroud having a top wall, spaced apart side walls, a back wall, and a short rear bottom wall extending forwardly of said back wall, latch means located between said side walls at a position to be engaged by said hook means when said shroud is brought into engagement with said skeletal body; and, said skeletal body including shroud engaging means in the form of lateral projecting means or slot means above said waterway defining portion; said shroud having skeletal body engaging means in the form of mating slot means or mating lateral projecting means adapted to engage said shroud engaging means when said shroud is brought into engagement with said skeletal body, and said shroud engaging means comprising said flanges at the upper end of said upright body portion and said skeletal body engaging means of said shroud including at least one rib or rail extending inwardly from an inner surface of at least one of said side walls and longitudinally of said shroud for defining with an inner surface of said top wall a slot for receiving one of said side flanges.

4. A shroud and skeletal body assembly for a trigger sprayer comprising: a skeletal body including a lower portion, an upright body portion extending upwardly from said lower portion and having a forwardly extending piston receiving portion, a waterway defining portion above said piston receiving portion and extending forwardly of the upright body portion, and hook means extending rearwardly from said upright body portion; a shroud having a top wall, spaced apart side walls, a back wall, and a short rear bottom wall extending forwardly of said back wall, latch means located between said side walls at a position to be engaged by said hook means when said shroud is brought into engagement with said skeletal body; and, said skeletal body including a rearwardly extending lower shelf and said shroud including at least one lower rib extending inwardly from an inner surface of at least one side wall just above said rear bottom wall for defining a slot with said bottom wall for receiving said shelf.

5. A shroud and skeletal body assembly for a trigger sprayer comprising: a skeletal body including a lower portion, an upright body portion extending upwardly from said lower portion and having a forwardly extending piston receiving portion, a waterway defining portion above said piston receiving portion and extending forwardly of the upright body portion, and hook means extending rearwardly from said upright body portion; a shroud having a top wall, spaced apart side walls, a back wall, and a short rear bottom wall extending forwardly of said back wall, latch means located between said side walls at a position to be engaged by said hook means when said shroud is brought into engagement with said skeletal body said skeletal body including shroud engaging means above said waterway defining portion and said shroud having skeletal body engaging means adapted to engage said shroud engaging means when said shroud is brought into engagement with said skeletal body comprising at least one lateral projection on said skeletal body and at least one rib extending inwardly from an upper surface of at least one of said side walls of said shroud and longitudinally of said shroud for defining, with an inner surface of said top wall or ceiling of said shroud, a slot for receiving said, hook means including a bar extending rearwardly from said upright body portion and having a hook formation at an outer end thereof for engaging said latch means which comprises abutment means located between said side walls, and a rearwardly extending lower shelf on said skeletal body; and said at least one lower rib extending inwardly from an inner surface of at least one side wall of said shroud just above said rear bottom wall for defining a slot with said bottom wall for receiving said shelf; said at least one lateral projection, said hook means and said shelf defining shroud engaging means and said upper rib, said abutment means, and said lower rib defining skeletal body engaging means.

6. The shroud and skeletal body assembly of claim 5 wherein said shroud engaging means further comprises side flanges at the upper end of said upright body portion, at least one of which is received in said at least one slot.

* * * * *

UNITED STATES PATENT AND TRADEMARK OFFICE

CERTIFICATE OF CORRECTION

PATENT NO. : 5,749,501

DATED : May 12, 1998

INVENTOR(S) : Wilhelmus J.J. Maas; Petrus L.W. Hurkmans

It is certified that error appears in the above-indentified patent and that said Letters Patent is hereby corrected as shown below:

Column 3, line 59, "projectig" should be -- projecting --.

Column 4, line 29, "said" should be -- side -- flanges.

Column 5, line 6, "upper" should be -- inner --.

Signed and Sealed this

Twenty-seventh Day of October, 1998

*Attest:*

Bruce Lehman

BRUCE LEHMAN

*Attesting Officer*

*Commissioner of Patents and Trademarks*